US006182917B1

(12) United States Patent
Lai

(10) Patent No.: US 6,182,917 B1
(45) Date of Patent: Feb. 6, 2001

(54) ELECTRIC STRETCHING/COLLECTING DEVICE FOR A PARASOL

(75) Inventor: Jin-Sheng Lai, Taipei (TW)

(73) Assignee: Great Mission Trading Limited, Tortola (VG)

( * ) Notice: Under 35 U.S.C. 154(b), the term of this patent shall be extended for 0 days.

(21) Appl. No.: 09/323,911

(22) Filed: Jun. 2, 1999

(51) Int. Cl.[7] ..... B65H 75/34; A45B 25/14; A45B 25/16

(52) U.S. Cl. ..... 242/390.8; 242/395; 135/20.3

(58) Field of Search ..... 242/395, 390.8; 135/20.3, 16

(56) References Cited

U.S. PATENT DOCUMENTS 4,386,621 * 6/1983 Redl ..... 135/20.3

5,711,333 * 1/1998 Vanderminden, Sr. ..... 135/20.3

* cited by examiner

*Primary Examiner*—Robert Canfield
(74) *Attorney, Agent, or Firm*—Bacon & Thomas, PLLC

(57) ABSTRACT

An electric stretching/collecting device for a parasol including a touch switch, a remote control circuit, a motor driving mechanism, a manually operated clutch mechanism and a ratchet damper mechanism. A motor serves to drive the motor driving mechanism to wind or unwind a cord for stretching/collecting the parasol. When the crank is switched, a clutching effect is provided to change the electrically driving operation into a manually driving operation. Therefore, the stretching/collecting device of the parasol is able to achieve double uses of manual and electric operation for conveniently stretching or collecting the parasol face.

1 Claim, 8 Drawing Sheets

ELECTRIC STRETCHING/COLLECTING DEVICE FOR A PARASOL

BACKGROUND OF THE INVENTION

The present invention relates to an electric stretching/collecting device for a parasol, in which a motor is used to automatically stretch or collect the parasol.

When a crank is switched, the electrically driving operation is switched to a manually driving operation. A remote controller also serves to control the stretching/collecting operation of the parasol so that the stretching/collecting operation of a large parasol can be more conveniently performed with strength saved.

A conventional parasol is stretched or collected by a cord winding mechanism which is manually operated via a crank. Such operation is laborious and time-consuming. In addition, articles are often placed at a position near the crank to limit the space for the cranking operation of the crank so that the cranking operation is often obstacled.

SUMMARY OF THE INVENTION

It is therefore a primary object of the present invention to provide an electric stretching/collecting device for a parasol, in which the stretching/collecting operation of the parasol can be switched between an electrical operation by a touch switch or a remote controller and a manual operation by a crank so that the stretching/collecting operation of a large parasol can be more conveniently performed with strength saved.

According to the above objects, the electric stretching/collecting device for a parasol of the present invention includes a touch switch, a remote control means, a motor driving mechanism, a manually operated clutch mechanism and a ratchet damper mechanism. The touch switch and the remote control means are respectively designed with related circuit elements connected to a motor. A first bevel gear is rotatably disposed on an output shaft of the motor for driving a second bevel gear of a horizontal transmission shaft for electrically stretching/collecting the parasol by the touch switch or remote control means. A manually operated clutch mechanism is disposed at one end of the transmission shaft, which is controlled by a crank to detachably engage with the transmission shaft and drive the same with a clutching effect. Therefore, the operation can be switched between an electric measure and a manual measure. In addition, a ratchet damper mechanism is disposed at a rear end of the transmission shaft, whereby the transmission shaft is one-way rotatable and when the parasol is stretched open to a maximum limit position, the damper mechanism serves to prevent the parasol from downward sliding.

The present invention can be best understood through the following description and accompanying drawings wherein:

DETAILED DESCRIPTION OF THE PREFERRED EMBODIMENT

Figure 1:
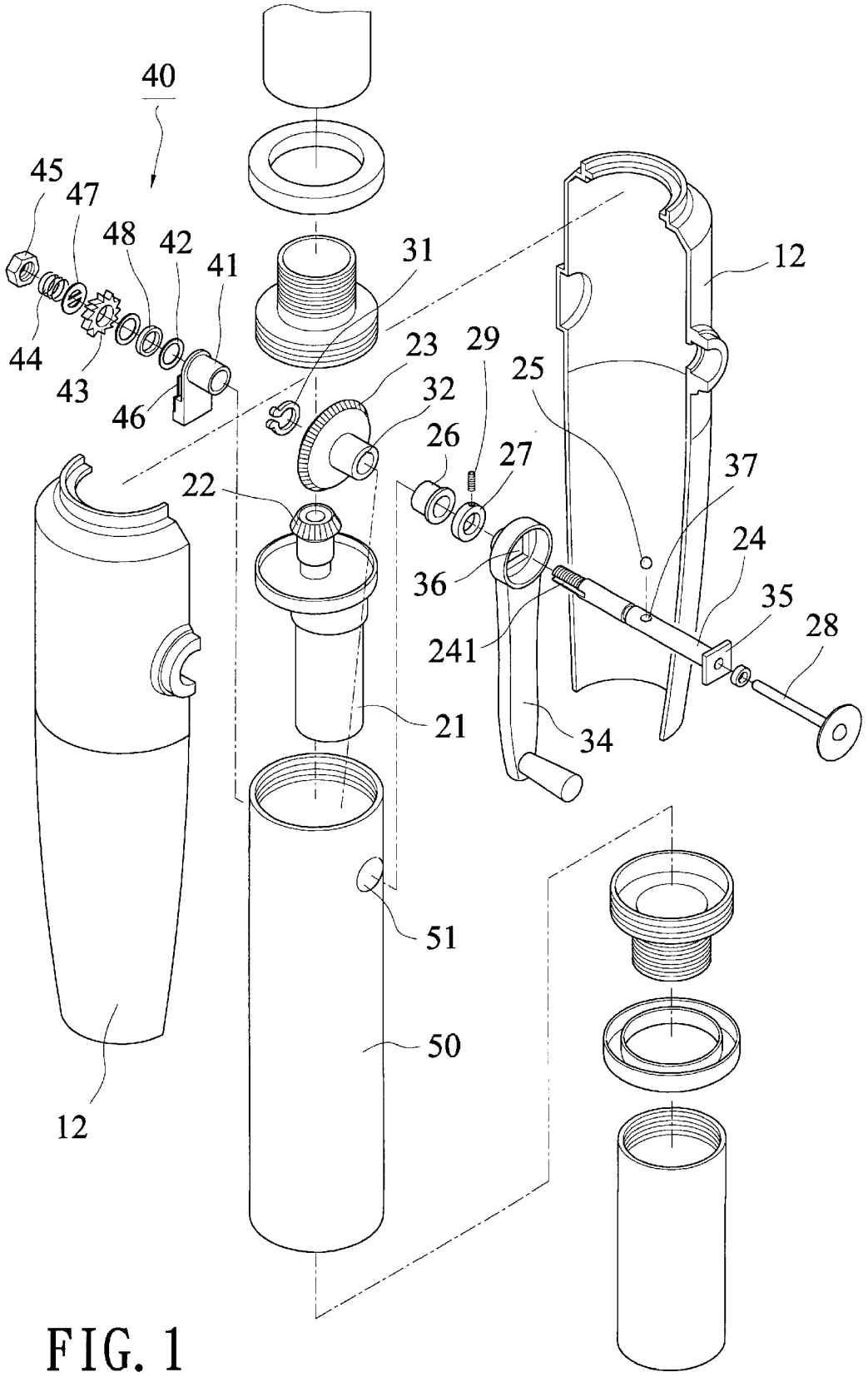
FIG. 1 is a perspective exploded view of the present invention.
Figure 4A:
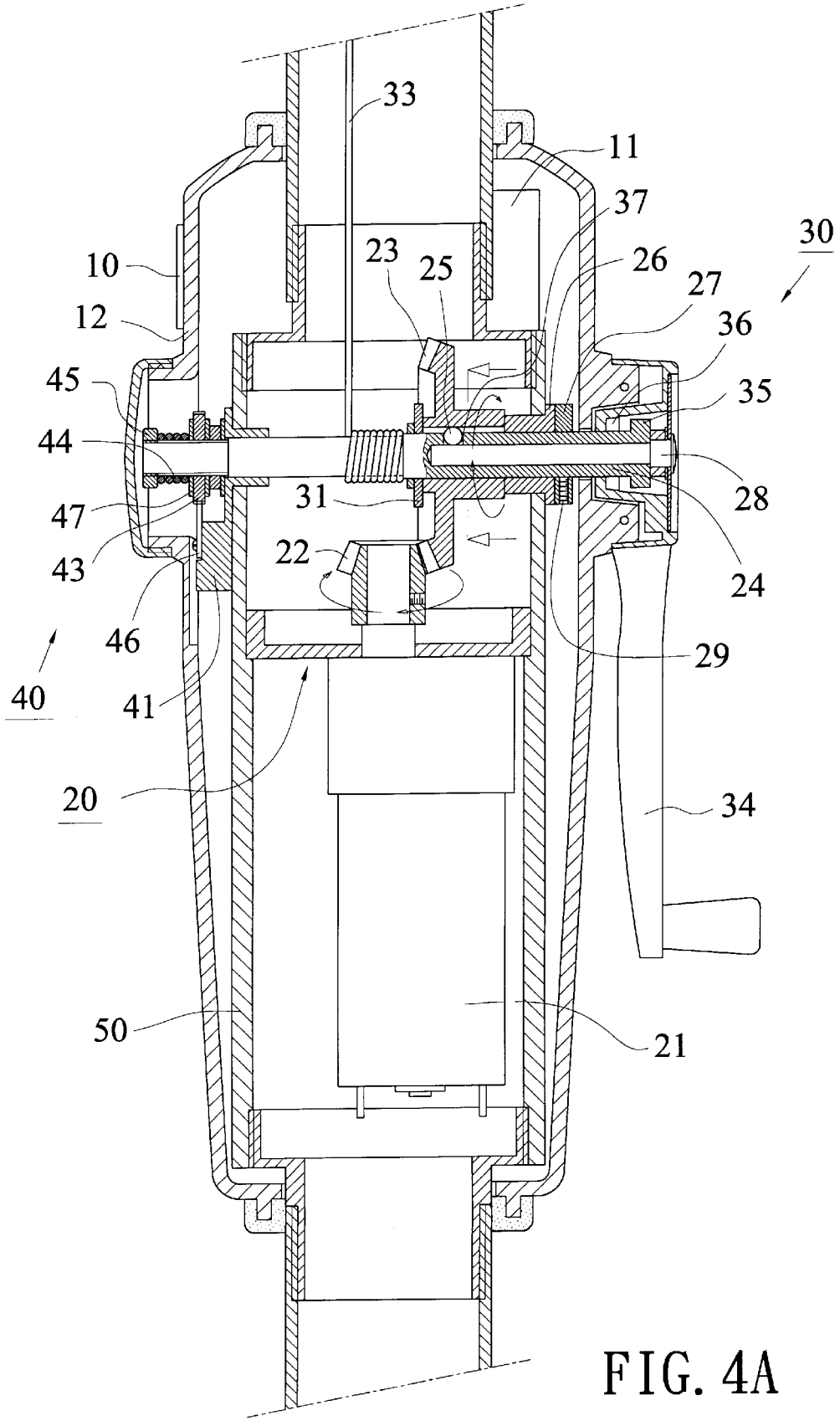
FIGS. 4A and 4B show that the cord winder of the present invention is electrically rotated to wind or unwind the cord.

Please refer to FIGS. 1 and 4A. The electric stretching/collecting device for a parasol of the present invention includes a touch switch 10, a remote control circuit 11, a motor driving mechanism 20, a manually operated clutch mechanism 30 and a ratchet damper mechanism 40. The touch switch 10 is a membrane-type switch attached to outer side of an outer housing 12. The switch is connected with a motor 21 of the driving mechanism 20. The motor is externally connected with a battery as a power source. The remote control circuit 11 is controlled by an external remote controller for controlling on/off of the motor 21.

The motor driving mechanism 20 includes a first bevel gear 22, a second bevel gear 23, a transmission shaft 24, a steel ball 25, a collar 26, an engaging ring 27 and a brake shaft 28. The output shaft of the motor 21 is rotatably fixed with the first bevel gear 22. The transmission shaft 24 is passed through a pin hole 51 of an inner tube seat 50. The second bevel gear 23, collar 26 and engaging ring 27 are sequentially fitted on the transmission shaft 24. The collar 26 is padded at the pin hole 51 and located on the transmission shaft 24 via the engaging ring 27 and a small screw 29. The front end of the second bevel gear 23 is fixedly stopped by a shaft latch 31 and located on the transmission shaft 24. The second bevel gear 23 meshes with the first bevel gear 22. The inner hole of the second bevel gear 23 is disposed with an engaging groove 32 for drivingly engaging with the steel ball 25 (referring to FIGS. 4B and 5B ). Accordingly, the brake shaft 28 extends to abut under the steel ball 25, making the steel ball 25 engaged in the transmission shaft 24 and the engaging groove 32 of the second bevel gear 23, whereby the transmission shaft 24 and the second bevel gear 23 form an integrated rigid body. By means of pressing the touch switch 10 or the remote control circuit 11, the motor 21 is activated to rotate and drive the second bevel gear 23 through the first bevel gear 22. At this time, the cord 33 is wound on the transmission shaft 24 to stretch open the parasol face.

Figure 2:
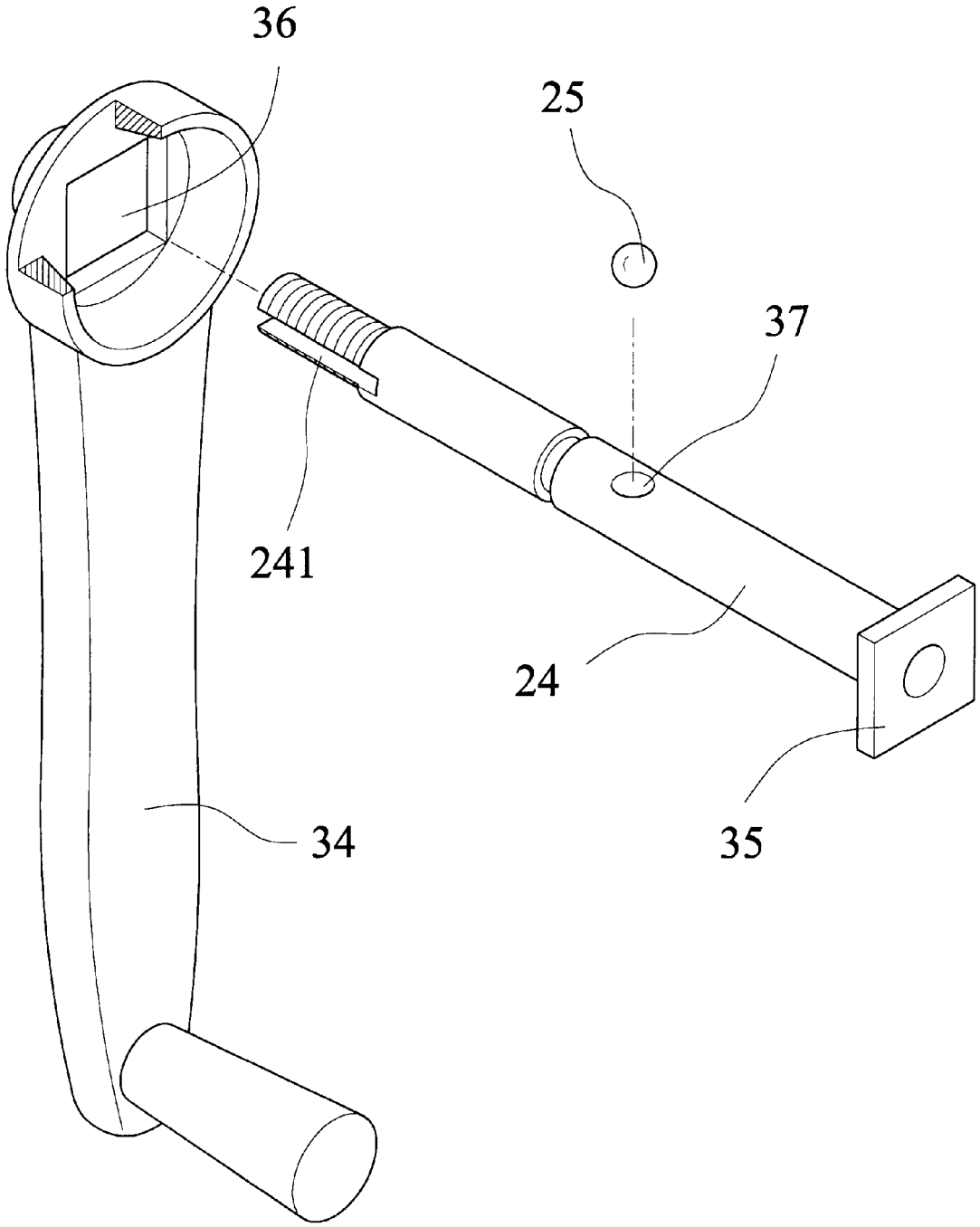
FIG. 2 is a perspective exploded view of the manually driving clutch mechanism of the present invention.
Figure 5A:
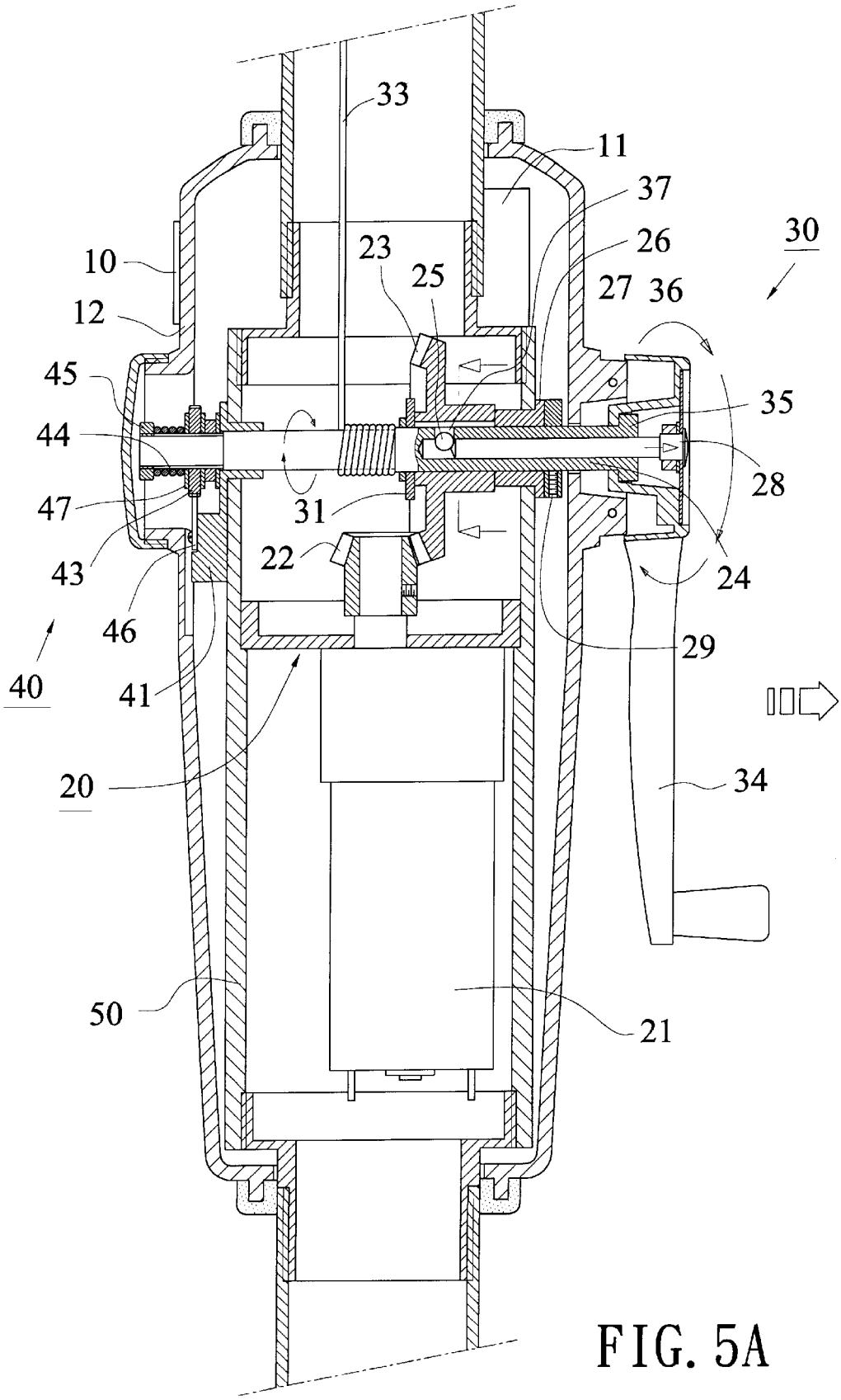
FIGS. 5A and 5B show that the cord winder of the present invention is manually rotated to wind or unwind the cord.

Referring to FIGS. 2, 4A and 5A, the manually operated clutch mechanism 30 is composed of a crank 34, a brake shaft 28, a transmission shaft 24, a collar 26, a steel ball 25, an engaging ring 27 and a small screw 29. When the crank 34 is pulled outward, the brake shaft 28 is outward pulled along with the crank 34. Due to retraction of the brake shaft 28, the steel ball 25 drops from the hole 37 of the transmission shaft 24 and disengages from the engaging groove 32 of the second bevel gear 23. A rectangular engaging section at an end of the transmission shaft 24 is engaged with an inner rectangular recess 36 of the crank 34, whereby the crank 34 can be rotated to directly drive the transmission shaft 24. At this time, the steel ball 25 is dropped so that the transmission shaft 24 is disengaged from the second bevel gear 23 with a clutching effect so that when rotating the crank 34, the motor 21 will not be driven to rotate.

Figure 3:
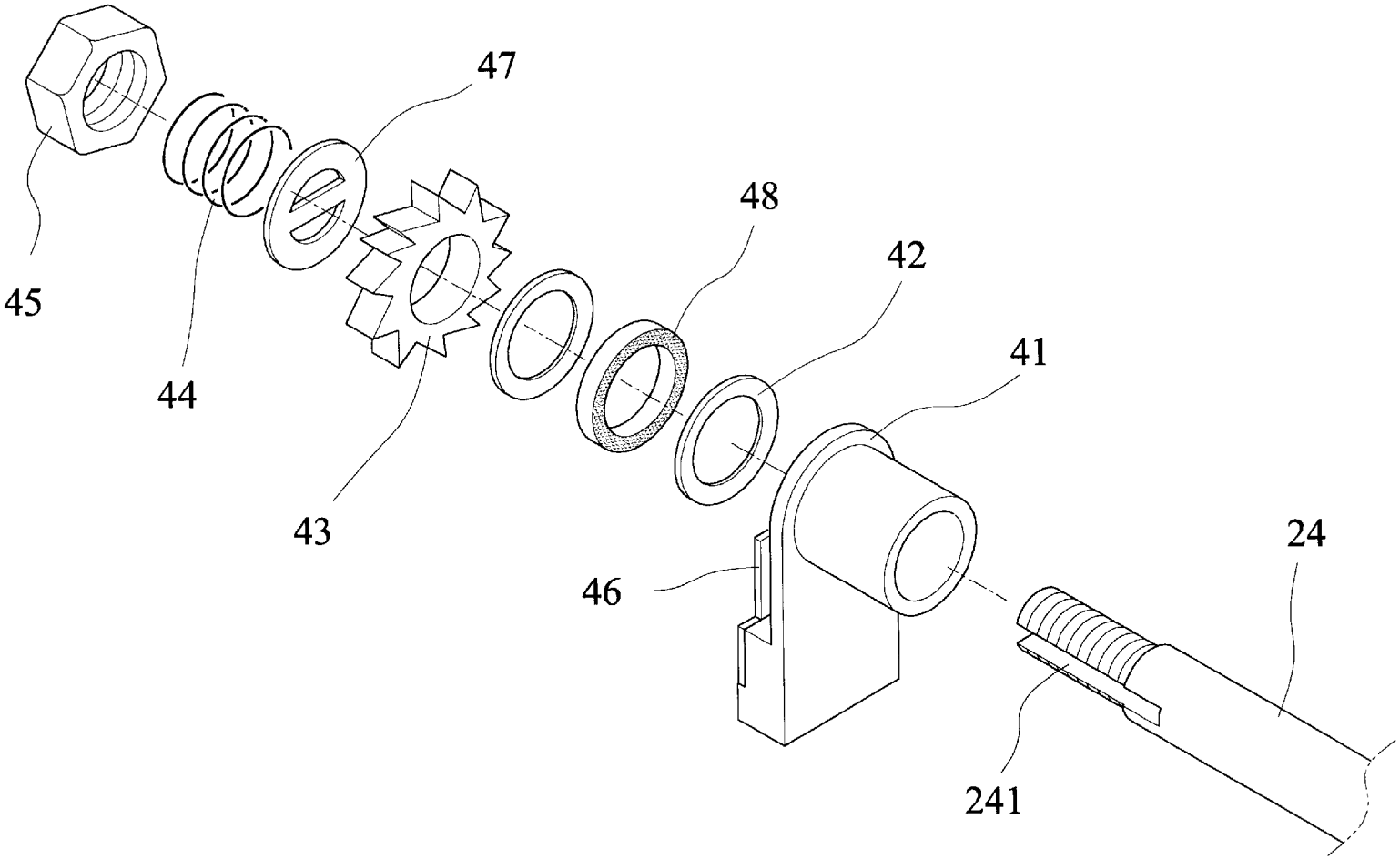
FIG. 3 is a perspective exploded view of the damper mechanism of the present invention.

Please refer to FIGS. 3, 4A and 5A, the damper mechanism 40 includes a pad sleeve 41, a washer 42, a ratchet gear 43, a spring 44, a check gasket 47, tightening nut 48 and tightening nut 45. A rear end of the transmission shaft 24 is passed through the tube seat 50 and then sequentially passed through the respective components of the damper mechanism and finally tightened by the tightening nut 45. The check gasket 47 is inserted into a fissure 241 at the end of the transmission shaft. A click 46 is locked on the pad sleeve 41. When rotating the crank 34, the ratchet gear 43 is tightened by the tightening nut 45 so that the check gasket 47 is rotated along therewith so as to stretch open the cord. When the cord is unwound to stretch open the parasol to a limit position, the ratchet gear 43 is stopped by the click 46 to provide a damping effect for preventing the parasol face from sliding downward. When reversely rotating the crank 34, the check gasket 47 is frictionally slided on the ratchet gear 43 to provide a certain torque for the transmission shaft 24 so as to lower and collect the parasol face.

Figure 4B:
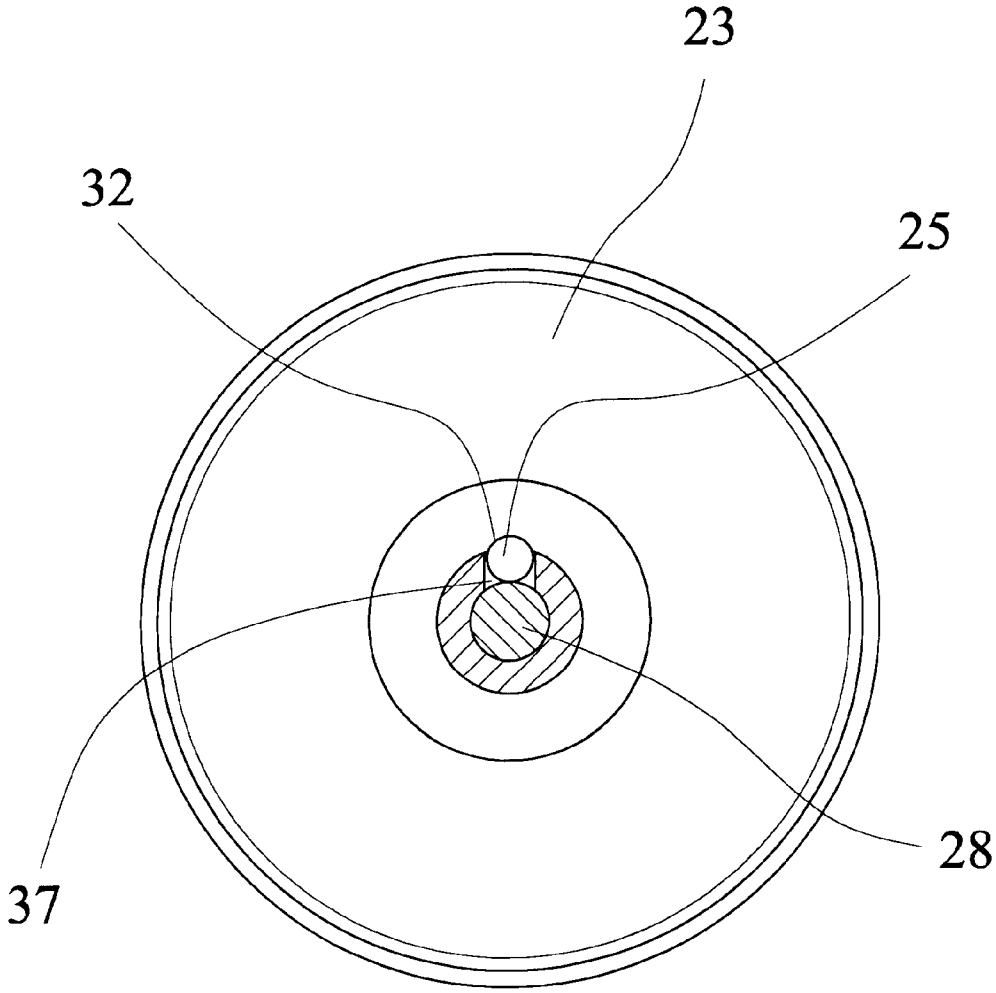
Figure 6:
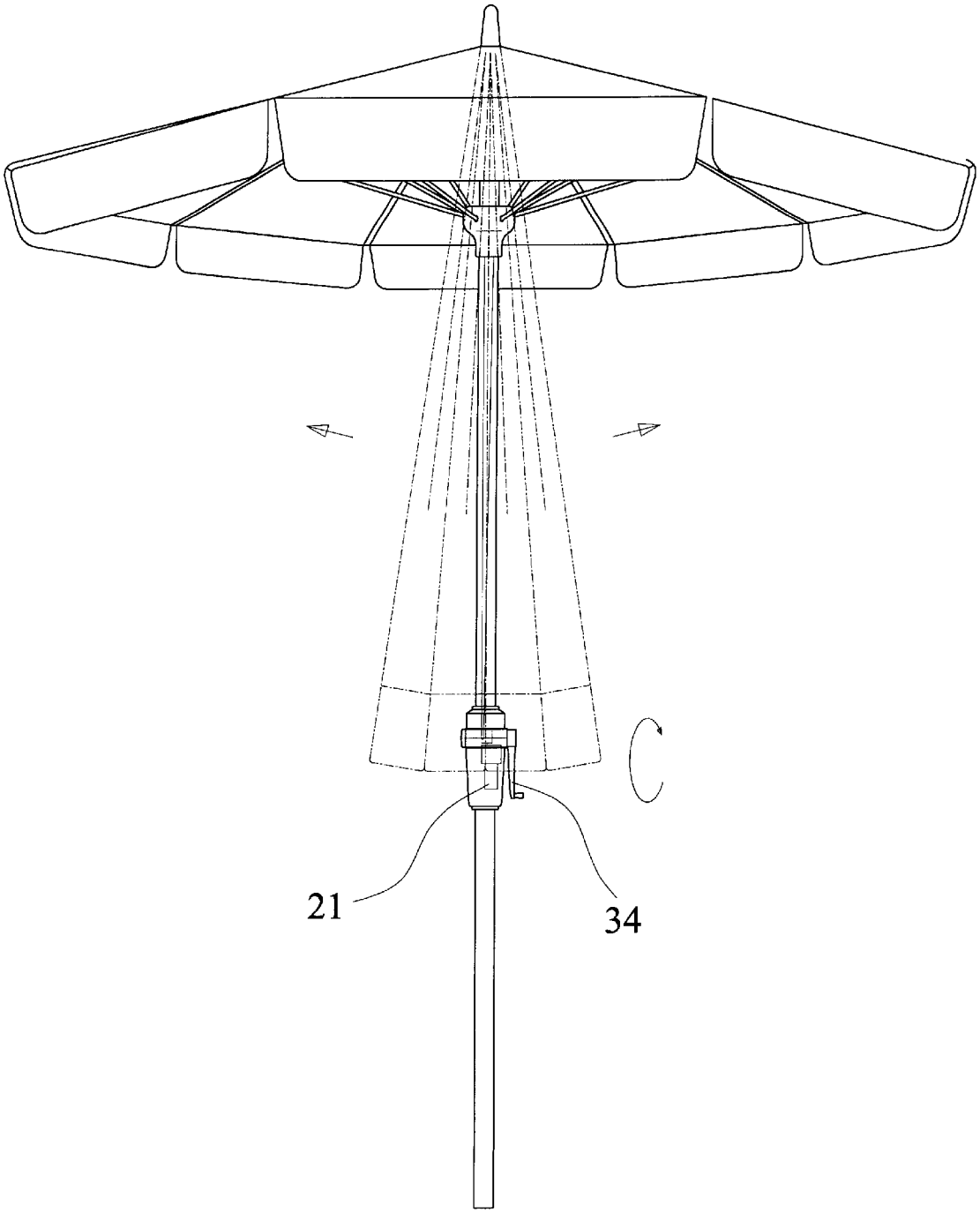
FIG. 6 shows the stretching/collecting operation of the parasol of the present invention.

As shown in FIGS. 4A and 4B, when electrically stretching/collecting the parasol, the brake shaft 28 is pushed inward to the transmission shaft 24 to force the steel ball 25 as a key to engage into the engaging groove 32 so as to engage the second bevel gear 23 with the transmission shaft 24. At this time, the first bevel gear 22 transmits the electrically driving force through the second bevel gear 23 to drive the transmission shaft 24 to rotate. When the motor 21 is activated, the parasol can be stretched open as shown in FIG. 6.

Figure 5B:
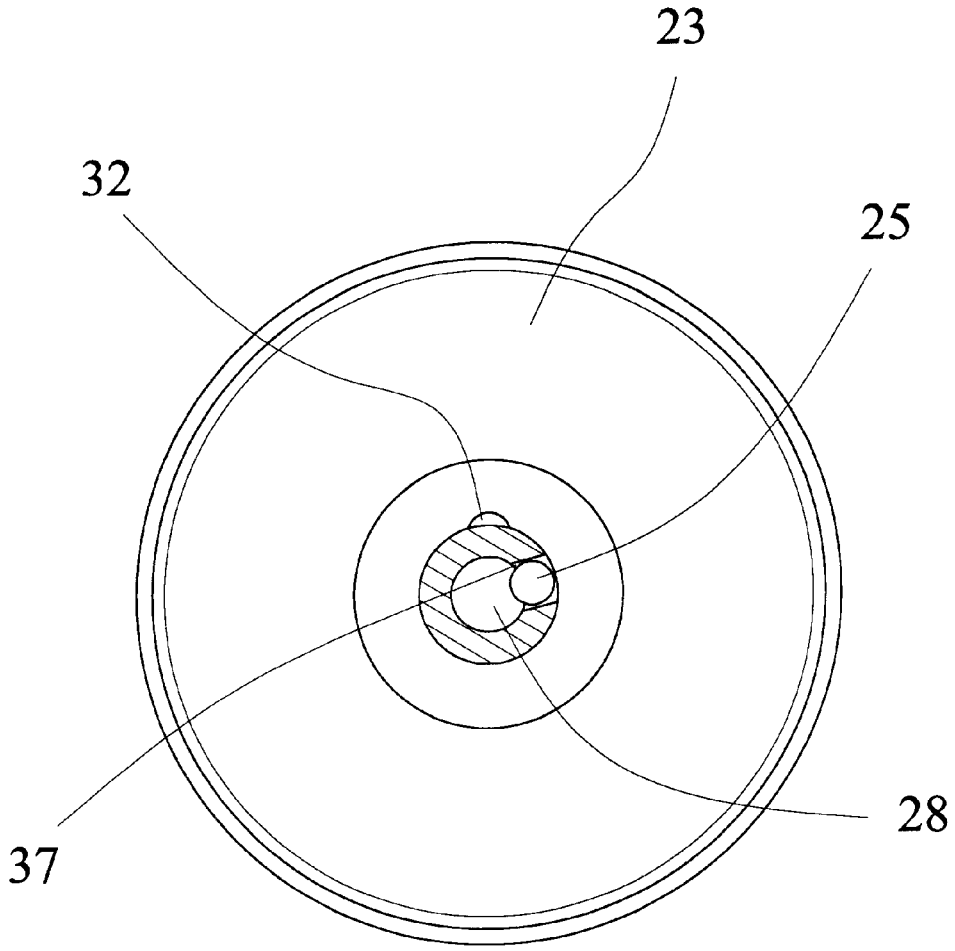

As shown in FIGS. 5A and 5B, when performing manually stretching/collecting operation of the parasol, the brake shaft 28 is pulled outward to outer side of the crank 34 to make the steel ball 25 drop from the engaging groove 32. At this time, the second bevel gear 23 cannot drive the transmission shaft 24 to achieve an idling effect. The rectangular engaging section 35 at the end of the transmission shaft 24 is engaged in the rectangular recess 36 of the crank 34. At this time, the crank 34 is engaged with the transmission 24 to directly control the stretching/collecting operation of the parasol, serving as a manually controlling structure as shown in FIG. 6.

According to the above arrangement, the stretching/collecting device for the parasol of the present invention employs a motor driving mechanism for stretching/collecting the parasol. In addition, the clutch mechanism provides a switching effect between the manual operation and electric operation and remote control operation, whereby the stretching/collecting operation of parasol can be performed in versatile and strength-saving manners.

The above embodiment is only used to illustrate the present invention, not intended to limit the scope thereof. Many modifications of the above embodiment can be made without departing from the spirit of the present invention.

What is claimed is:

1. An electric stretching/collecting device for a parasol, comprising:

an electric touch switch and a remote control means, the touch switch and remote control switch being connected with a motor for driving the same;

a motor driving mechanism having a first bevel gear fixed at an output end of the motor, a transmission shaft being passed through an inner tube seat, a second bevel gear being rotatably disposed on the transmission shaft and engaged with the first bevel gear, whereby the motor can through the first bevel gear drives the second bevel gear so as to drive the transmission shaft to wind or unwind a cord for stretching/collecting the parasol;

a manually driving clutch mechanism having a crank connected with the transmission shaft through a brake shaft and a steel ball, the steel ball being positioned between the transmission shaft and the second bevel gear, the brake shaft being passed through an inner hole of the transmission shaft to force out the steel ball, an inner hole of the second bevel gear being disposed with an engaging groove, an inner face of the crank being formed with a recess for detachably engaging with an engaging section at the end of the transmission shaft to provide a clutching effect, when the crank is pulled outward to retract the brake shaft, the steel ball being dropped and the second bevel gear being disengaged from the transmission shaft, whereby the stretching/collecting operation of the parasol can be directly controlled by means of rotating the crank; and a damper mechanism including a pad sleeve, a washer, a ratchet gear, a spring, a check gasket and tightening nut, a rear end of the transmission shaft being passed through the tube seat and then sequentially passed through the respective components of the damper mechanism and finally tightened by the tightening nut, a click being locked on the pad sleeve for abutting against the ratchet gear, whereby the motor serves to drive the motor driving mechanism for stretching/collecting the parasol and when the crank is pulled outward, the electrically driving operation is switched to the manually driving operation.

* * * * *